United States Patent [19]

Friedman et al.

[11] Patent Number: 4,908,996

[45] Date of Patent: Mar. 20, 1990

[54] METHOD FOR MACHINE POLISHING OPHTHALMIC LENSES TO A TRANSLUCENT FINISH

[75] Inventors: Joel Friedman, Wheeling; Jean J. Bouvier, Palatine; Yordan Vulich, Oak Lawn, all of Ill.

[73] Assignee: Abraxas, Incorporated, Schaumburg, Ill.

[21] Appl. No.: 99,915

[22] Filed: Sep. 22, 1987

[51] Int. Cl.[4] ..... B24B 9/14; B24B 13/00; B24D 5/02

[52] U.S. Cl. ..... 51/284 R; 51/284 E; 51/298; 51/309; 51/206 R; 51/209 DL

[58] Field of Search ..... 51/101 LG, 206 R, 209 R, 51/209 DL, 284 R, 284 E, 298, 309, 394, DIG. 34

[56] References Cited

U.S. PATENT DOCUMENTS

| | | | |
|---|---|---|---|
| 2,355,345 | 8/1944 | Walker | 51/284 |
| 2,450,433 | 10/1948 | Leeman | 51/284 |
| 3,710,517 | 1/1973 | Valerio et al. | 51/284 |
| 4,131,436 | 12/1978 | Wiand | 51/309 |
| 4,233,784 | 11/1980 | Loreto | 51/106 LG X |
| 4,383,393 | 5/1983 | Takubo | 51/101 LG |

FOREIGN PATENT DOCUMENTS

| | | | |
|---|---|---|---|
| 2043501 | 10/1980 | United Kingdom | 51/DIG. 34 |

*Primary Examiner*—Robert P. Olszewski
*Attorney, Agent, or Firm*—Juettner Pyle Lloyd & Verbeck

[57] ABSTRACT

A method and apparatus is provided for machine polishing plastic ophthalmic lenses to a translucent finish using a polishing wheel with 7 micron or less sized diamond particles held in a binder, such as a resin or bronze. The polishing wheels of the present invention may be in the form of a wheel for polishing edges of the lenses, or a wheel called a generator tool or bell for polishing the optical surfaces of the lenses. Either form of wheel may also be used on glass lenses. Each form may be used on a special ophthalmic machine adapted for its use, which may be capable of automatic or semi-automatic operation, to easily and quickly produce finished lenses. With the generator form polishing wheel of the present invention, a new type ophthalmic machine may be made using generator tools for both forming or cutting and finer finishing or polishing the optical surfaces of either, or both, plastic and glass lenses. To facilitate production, this new machine may incorporate a turret for changing generator tools and quickly cutting and polishing the lens.

21 Claims, 4 Drawing Sheets

METHOD FOR MACHINE POLISHING OPHTHALMIC LENSES TO A TRANSLUCENT FINISH

This invention relates to a method and apparatus for machine polishing plastic material to a fine translucent surface finish, and particularly for polishing the optical surfaces and edges of plastic and also glass ophthalmic lenses to such a finish.

BACKGROUND OF THE INVENTION

In the art of making ophthalmic lenses, it is necessary to form the lens to the desired optical power and to fit the lens to the glasses frame.

In the past to establish the optical power, the optical surfaces of the lens may have been rough cut or ground by use of generator tool, sometimes also called a generator ring or bell, and then, subsequently first fine finished, second fine finished, and finally polished to a translucent smooth surface finish using abrasive pads, such as shown in U.S. Pat. Nos. 3,225,497 and 3,522,680. Both glass and plastic lens optical surfaces have been machine finished to translucent finishes using the above or similar techniques. Generally, the initial grinding to form the optical surface took about twenty to thirty seconds, the first fine finish took about two minutes, the second fine finish took about two minutes, and the final polishing took about four to six minutes, giving a total time of about 8½ to 10½ minutes per lens. The above are machine operating times and do not include the time to mount and demount the lens. Usually, the generator ring machine was used for grinding; similar or other machines could be used for each of the two fine finishes; and abrasive pads were used for polishing the optical surfaces of the lens. Thus, it was necessary to set-up the lens four times, once on each machine. This resulted in additional time, effort and expense. While generator tools have been used to cut and first and second fine finish lenses, heretofore, it is not believed generator tools or rings have been capable of and/or used to final polish the optical surfaces of the lens to a translucent finish. That is because, heretofore, generator tools or rings were relatively coarse and not capable of providing a smooth translucent polished finish.

That prior art generator tools were not, heretofore, used for polishing is born out by the fact that many of the generator machines now is use are not sufficiently rigid and or close toleranced enough to carry out a polishing operation.

After the optic power of the lens is established, the edges of the lens are ground to fit the selected frame. For example, see U.S. Pat. Nos. 3,673,738; 4,176,498; 4,233,784 and 4,286,415, which patents are incorporated herein by reference. In these patents, the lens whose edge is to be ground is mounted between a pair of blocks which are rotated by a motor. The edge of the lens is engaged first with a generally flat grinding wheel to bring it to the overall desired size, and then the lens is engaged with a second wheel which can have various retaining shapes, such as a bevel. The second wheel may have, for example, a V-shaped groove formed therein and causes a complimentary raised groove to form on the lens suitable for mounting the lens in similar groove on the frame. The shaped edge of the lens is then polished to a translucent finish.

Generally with glass lenses there has been no problem in polishing the edge as the glass can be machine finished to a smooth, translucent surface with prior art polishing wheels. Even if the entire glass lens is not hidden by the frame, only the relatively smooth, translucent or polished glass is exposed. For example see U.S. Pat. No. 3,710,517 which discloses a process for finish polishing glass lenses using a lap material made from diamond particles of an average diameter of 12 microns (8 to 16 microns being preferred) in a an epoxy binder which can be molded to various forms.

Polishing the edges of plastic lenses (such as polycarbonate plastic) to a translucent finish, still presented a problem. Plastic ophthalmic lenses, of course, have come into widespread use because they are lighter in weight than glass, and thus, cause the wearer less discomfort, if worn for a long period of time. However, heretofore, one of the disadvantages of plastic ophthalmic lenses has been that when machine ground to size and machine shaped or beveled on equipment, like that discussed above, the edges of the lens were not completely translucent, but had an opaque or frosted appearance. While the opaque edge was not a problem where the lens edges were completely hidden by the frame, it was a problem in certain powers and certain type or style frames. In higher power optic lenses, generally, at least a portion of the lens edge was exposed no matter what the frame style chosen. In half, partial or rimless frames, again, at least a portion of the lens edge was exposed. In these situations, it was particularly desirable for appearance sake to provide a translucent and not merely opaque or frosted surface on the edge.

While the optical surfaces of plastic lenses have been machine lapped to a translucent finish, this technique could no be used on lens edges as they are not as uniform as the optical surface, the edges being in different shapes to conform to various style frames. Heretofore, it was impossible to polish the edges of plastic lenses on the same machine used to grind and bevel the edges of the plastic lens. Instead, the plastic lens had to be removed from the edging machine and manually polished, using, for example, a buffing wheel and buffing compound. This of course resulted in increased time, labor and cost in manufacture of the finished lens. Further, the time to manually polish the lens was considerably longer than if a machine operation was possible. Heretofore, such machine operation was not possible because the polishing wheels previously used on such edging equipment were not capable of providing the desired smooth translucent surface to the plastic lenses, but instead tended to chip or otherwise mar or scratch the plastic. At best, while somewhat smooth, the plastic edge was still opaque or frosted in appearance.

SUMMARY OF THE INVENTION

In accordance with the present invention a method an apparatus have been devised for machine polishing plastic and also glass ophthalmic lenses to a translucent finish.

The method of the present invention comprises the steps of rough cutting or grinding the lens to size, and then polishing the lens with the polishing wheel of the present invention. The polishing wheel of the present invention can be in the form of a generator tool (ring or bell) for polishing the optical surface of the lens or an edge polishing wheel for use on a conventional ophthalmic edger, such as described in some of the above patents. The polishing wheel of the present invention, whether for the generator tool form or edger polishing form, comprises a plurality of small size diamond particles mounted in a matrix or binder. Generally the diamond particles are no greater than seven (7) microns in size, and preferably about five (5) to three (3) or less microns.

Preferably, the matrix or binder holding the diamond particles is relatively soft, as that term is generally understood in the diamond wheel industry. A soft binder is one that will not mar or scratch plastic lens material, and generally, is softer than a medium bronze. The matrix may be metallic, such as a soft bronze, or non-metallic, such as a resin, for example a phenolic. Constructing a polishing wheel as described, but using a matrix at the more wear resistant end of this range has the additional advantage of resulting in a longer life wheel when used to polish both plastic and glass.

In fact, the polishing wheel of the present invention makes possible a new type generator tool machine for in addition to, cutting, also finer finishing and/or polishing the optical surface of the lenses. This new generator tool machine may have both a cutting generator tool and one or more finer finishing and/or polishing generator tools, the generator tools alone or with the lens being turret mounted so that the tools can be quickly and easily brought to bear on the lens being worked. With the generator tool and machine of the present invention, one or more of the intervening finishing operations can be eliminated so that the machine operating time to produce an optical surface on a lens is reduced from eight to ten minutes to about two minutes, and most, if not all, set-ups, except for the first, can be eliminated. Likewise, plastic as well as glass lenses can now be automatically machine edged, and all the hand polishing eliminated.

OBJECTS OF THE INVENTION

An object of the present invention is to provide a method and apparatus for machine polishing plastic lenses.

Another object of the present invention is to provide a method and apparatus for machine polishing plastic lenses with a wheel having small size, seven micron or less, diamond particles mounted in a soft matrix binder.

A further object of the present invention is to provide a polishing wheel for machine polishing of plastic lenses utilizing small size, seven micron or less, diamond particles, held in a soft matrix binder.

Yet a further object of the present invention is to provide a method and apparatus for polishing the optical surfaces of a plastic or glass lens with a generator type ring to a translucent finish.

A still further object of the present invention is to provide a method and apparatus for polishing the edges of a plastic lens to a translucent finish.

Still another object of the present invention is to provide a method and apparatus for both cutting or grinding and finer finishing or polishing the optical surfaces of lenses with generator type tools.

Still yet another object of the present invention is to provide a method and apparatus for forming lenses by quickly moving the lens into contact with a conventional generator tool and then a finer finishing or polishing generator tool by means of a turret or the like.

A yet further object of the present invention is to provide a method and apparatus for adapting existing generator machines to carry out polishing operations.

A still further object of the present invention is to provide a generator tool having a reduced surface contact so that existing generator machines may be able to carry out polishing operations.

These and other objects, advantages and features of the method and apparatus of the present invention will become apparent from the following written description and the accompanying drawing.

DESCRIPTION OF THE PREFERRED EMBODIMENTS

Figure 1:
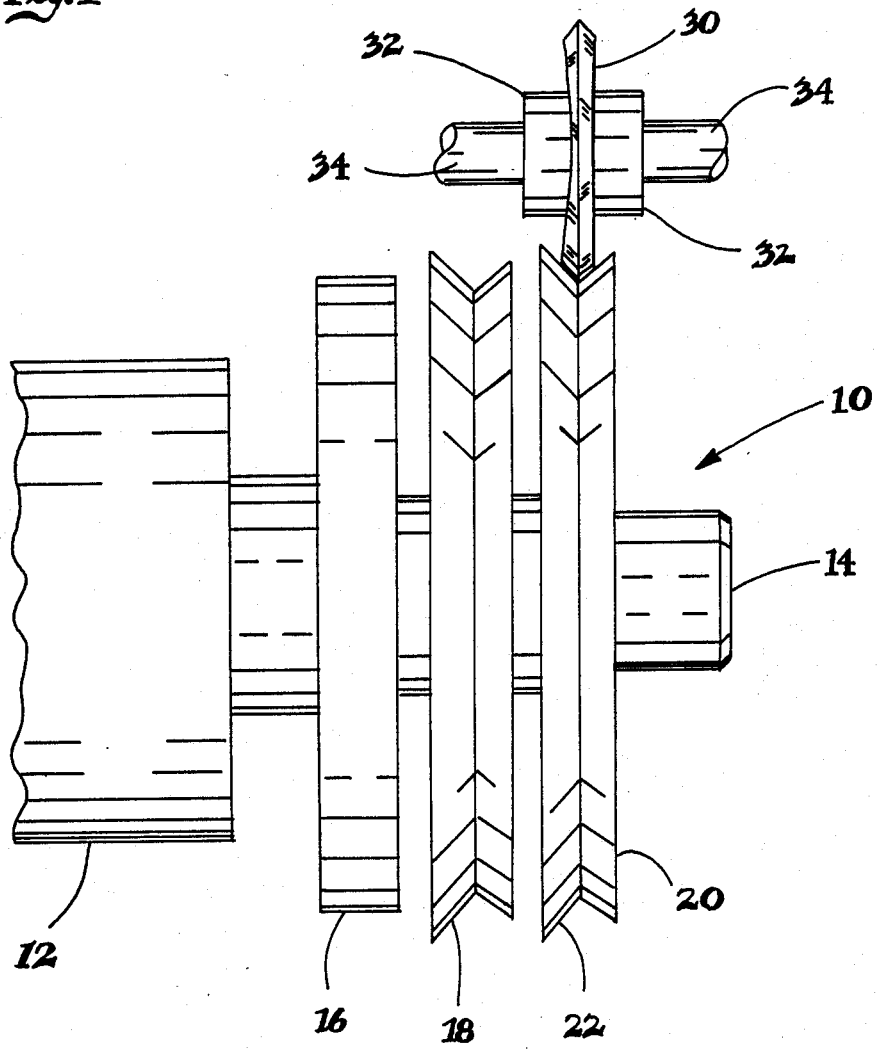
FIG. 1 is a schematic view of a plastic lens being held for edge polishing with the method and first form of polishing wheel of the present invention.

Referring to FIG. 1, a conventional automatic machine 10 for edging ophthalmic lenses is shown schematically. Generally, machine 10 can be of the type described in U.S. Pat. No. 4,176,498; 4,233,784 or 4,286,415. Machine 10 has a motor 12 which drives a rotating shaft 14 upon which three wheels 16, 18 and 20 are mounted by conventional means so as to rotate with the shaft 14. The wheel 16 is a conventional roughing wheel for rough sizing by grinding the edge of the lens to fit the desired frame opening. The wheel 18, in this instance, is a conventional bevel wheel, for grinding a bevel onto the lens to mount the same in certain style glass frames. As is conventional, neither of wheels 16 or 18 can provide a fine, smooth and translucent finish on the edge of a plastic lens.

The wheel 20 is the ophthalmic polishing wheel of the present invention in the form of an edge polisher which can polish a plastic lens edge to a translucent finish, and with some constructions also polish glass lens edges to such a finish. The polishing wheel 20 comprises an outer surface 22, having a plurality of diamond particles thereon of a size of seven (7) microns or less. The diamond particles may be in concentrations of 30 to 250 as that term is used in the diamond wheel industry. The diamond particles are preferably held to the wheel by what is considered a soft binder in the ophthalmic diamond wheel industry, examples of such being non-metallics, such as resin and phenolic binders, and metallic binders, such as soft bronze. Generally a soft binder is preferred, as harder binders, such as a medium bronze may have some tendency to mar a plastic. Of course, the harder the binder, the more likely the binder is to give a long wheel life and be more wear resistant, particularly if the wheel is to be used on both plastic and glass lenses.

The wheel of the present invention can be manufactured by conventional prior art mixing and molding techniques used to make micron size diamond wheels with such binders, but used for other purposes, such as making industrial grinding wheels for grinding computer disc reader heads.

As is shown in FIG. 1, a plastic lens 30 to be made to fit the glasses frame opening (not shown) is mounted in a pair of work holders 32, which in turn, are mounted on a pair of rotatable and axially and radially movable shafts 34. The shafts 14 and 34 move in the manner described, for example, in U.S. Pat. No. 4,176,498, 4,233,784 or 4,286,415.

In manufacturing the finished plastic lens, after it has been ground to the desired optic power, its edge is then finished. The edge is first brought into contact with the roughing wheel 16 to grind it to its general final shape. Then the lens 30 is brought into contact with the shaped or bevel wheel 18 to give the lens the desired male shape or bevel to permit a female groove in the frame to retain the lens. Lastly, the already beveled lens 30 is then brought into contact with the polishing wheel 20 of the present invention, to be automatically machine polished on its outer edge to a high luster and a translucent appearance. For certain frames, the beveling or shaping process may not be needed, and the lens is polished right after being rough sized. All these steps are carried out automatically, without having to change the lens set-up or do any manual polishing, as is believed the only way prior art plastic ophthalmic edges of lenses could achieve a translucent finish.

Figure 2:
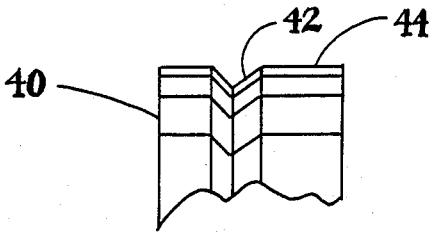
FIG. 2 is a partial elevational view of a second form of edge polishing wheel of the present invention.
Figure 3:
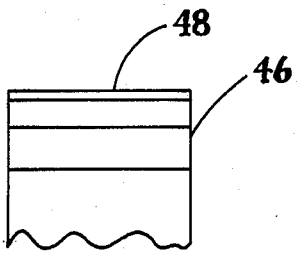
FIG. 3 is a partial elevational view of a third form of edge polishing wheel of the present invention.
Figure 4:
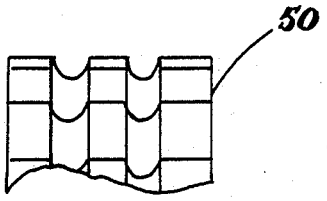
FIG. 4 is a partial elevational view of a fourth form of edge polishing wheel of the present invention.
Figure 5:
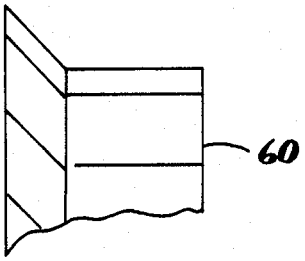
FIG. 5 is a partial elevational view of a fifth form of edge polishing wheel of the present invention.
Figure 7:
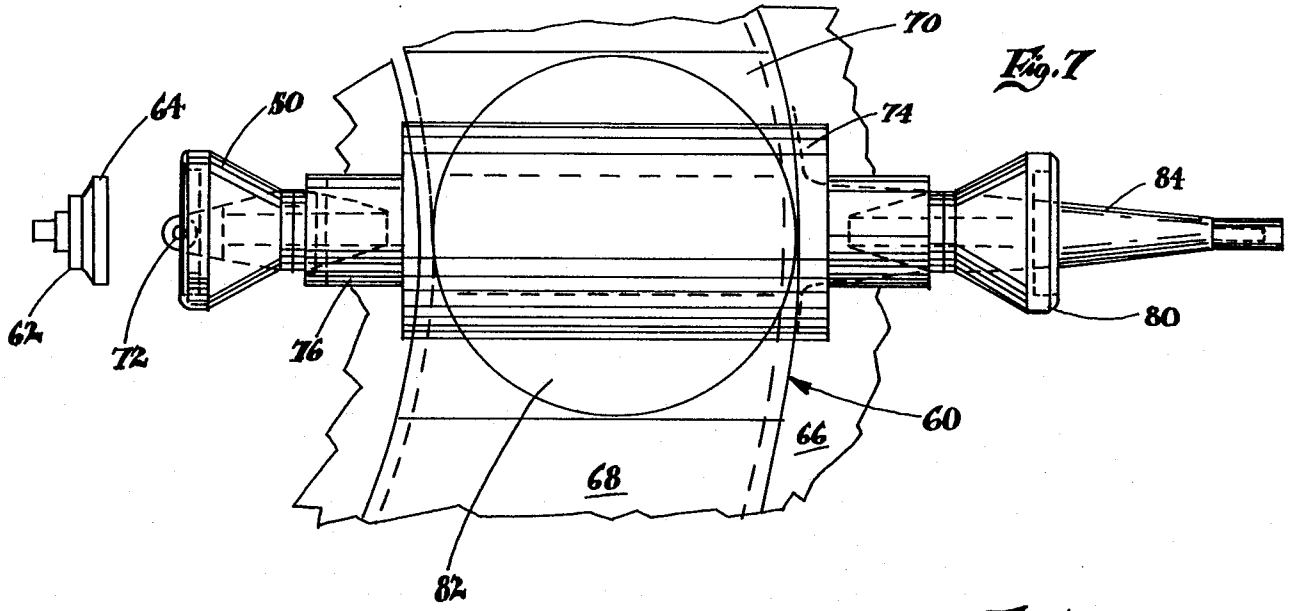
FIG. 7 is a plan view of the machine shown in FIG. 6.

While a V grooved edge bevel wheel 18 and a complimentary V groove edge polishing wheel 20 are shown in FIG. 1, the polishing wheel of the present invention could be of another shape or form. For example, as shown in FIG. 2, the polishing wheel 40 of the present invention is shown with a profile suitable for both hide-a-bead and rimless glasses, the small "v" 42 being for the former and the flat portion 44 for the latter. FIG. 3 shows a polishing wheel 46 of the present invention having a flat outer diameter surface 48 for just rimless frame lenses. FIG. 3 is also representative of the wheel of the present invention used for hand polishing to break the outer edges (+side and −side) of the lenses, should such be desired. FIG. 4 shows a polishing wheel 50 of the present invention for forming a shaped edge known as roll and polish. FIG. 5 shows a polishing wheel 56 of the present invention for faceting plastic lenses. Of course, where necessary, the other wheel or wheels on the automatic edger machine would be shaped in a manner to compliment the respective polishing wheels (shown in FIGS. 2–5) of the present invention for the lenses.

Both the non-metallic and metallic binder polishing wheels of the present invention work on plastic and glass lenses. Thus, a single lens edging machine with a soft bronze or resin binder polishing wheel of the present invention can be used to produce translucent lens edges on both glass and plastic. However, the harder binders may give a longer wheel life. This achievement in automatic machine polishing to a translucent finish of both glass and plastic lenses was not believed possible until the present invention.

While initially it was thought that the polishing wheel for the present invention could be used for edges, it was discovered that the concepts of the present invention could also be used to develop a generator type tool or wheel for polishing the optical surfaces of plastic and glass lenes.

Previously the optical surfaces were polished using several separate machines and finally a polishing pad, such as shown in U.S. Pat. No. 3,225,497 or 3,522,6.80 The prior art technique was slow in operation compared to using a generator type tool or wheel and required the transfer of the lens to as many as four different machines. As a consequence, it was more time consuming and expensive to produce lens with the prior technique. In addition, as several set-ups were previously required, this often introduced inaccuracies in the lens as it usually was impossible to achieve the exact desired position in all machines. These inaccuracies had to be corrected, resulting in additional machine time. These disadvantages are eliminated by making a generator polishing tool or wheel and a new type ophthalmic machine of the present invention. Such a generator polishing wheel 50 is shown in FIGS. 6 through 9 and is of a configuration similar to that of a conventional cutting generator tool, but has diamond particles sized and a binder in accord with the present invention.

Figure 6:
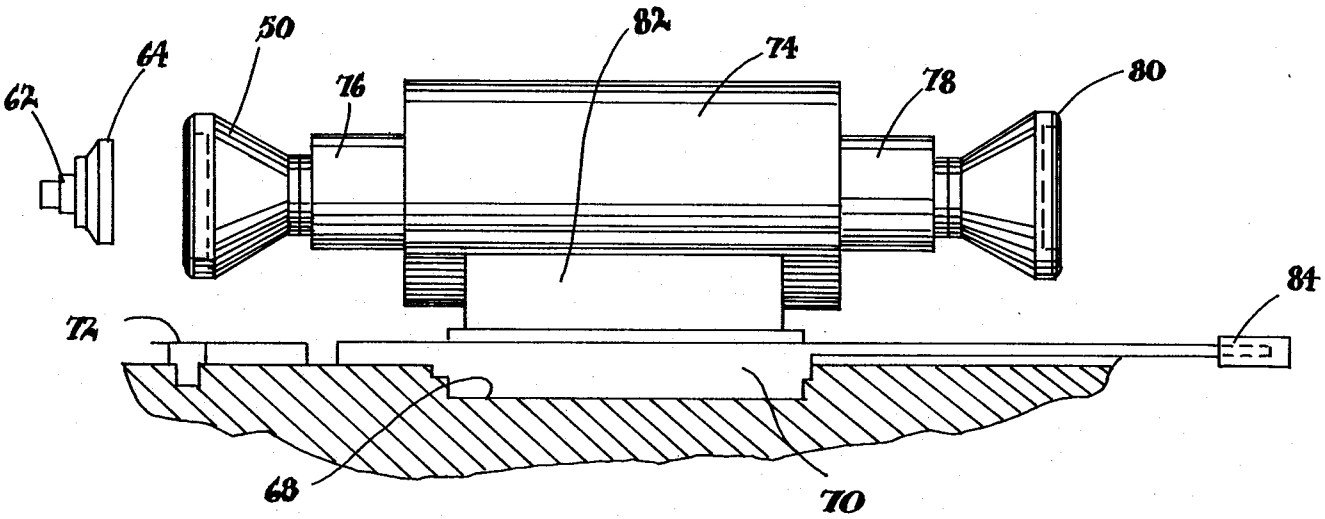
FIG. 6 is a schematic view of a generator tool type machine for grinding and polishing lenses, having a conventional cutting generator tool and a polishing generator tool mounted on a turret mechanism.

The new type ophthalmic generator machine 60 includes conventional means 62 for holding the lens 64 which is to be formed. The lens 64 is secured to the lens holder 62 in a conventional manner. Though not shown, the lens holder 62 is supported on the machine base 66 (FIG. 6). The machine base 66 provides a cross curve or track 68 in which a cross curve deck 70 can move. The cross curve deck 70, in turn, is mounted at the left end of FIG. 6 to pivot about a pivot point 72. A drive means or motor 74 is mounted to the cross curve deck 70 in a manner that the motor shaft ends 76 and 78 can be relatively moved toward or away from the lens holder 62 and lens 64 to alter the adjustment or spherical setting for the lens being machined.

As is shown, one end 78 of the motor 74, drives a conventional cutting or grinding generator tool 80. A conventional cutting or grinding generator tool would have an abrasive grit size of between 840 microns to about 140 microns if it were used for plastic lenses, and about 140 microns to 50 microns if it were used for glass lenses. The other end of the motor drives, in an opposite direction, a finer finishing or polishing generator 50 of the present invention having the much finer diamond particles.

In addition to being able to move relatively axially toward and away from the lens holder 62 and lens 64, the motor 76 is mounted so that either generator tool 80 or 50 can be brought quickly into contact with the lens being ground. To this end, the motor 74 and base 66 have a turret mechanism 82 which permits either the conventional generator tool 80 or the generator tool 50 of the present invention to be brought into engagement with the lens. The turret mechanism 82 may be of any conventional type used in the machine tool industry and be either manually operated or automatically operated. Similarly the impartation of pivoting motion to the generator tool 50 or 80 being used may be manual, as by motion of the handle 84, or fully automatic by mechanisms in the base moving the cross curve deck 70 in the cross curve or track 68 and about the pivot point 72.

The operation and method for forming the optical surface of the lense is as follows. The lens is mounted in the work holder and then the conventional generator tool 50 is swung into place to ut or grind the lens toward its desired final, but unpolished shape. Then the turret mechanism is turned to remove the tool 80 and bring the tool 50 of the present invention into position to engage the lens (position shown in FIGS. 6 and 7). The lens may then be polished to its final translucent finish.

The machine 60 may be used with either glass or plastic lenses. While there are some generator machines which use a turret for the work piece,, providing a work station and an unloading station for a single conventional generator tool, the machine of the present invention is the first to provide a conventional generator tool and a polishing generator tool mounted on a turret so that either tool may be engaged with the lens.

If desired, the polishing of the optical surfaces may be carried out in two phases, first an initial polishing and then a final polishing. The two stage polishing approach permits the final polishing to be with a smoother or finer diamond abrasive generator tool. In such case, the generator machine would be provided with a cutting generator as described above and two polishing generators. The first polishing generator would carry coarser diamond particles, say 10 microns or larger, and the second polishing generator would carry the finer diamonds, say 7 microns or smaller, with 3–5 microns being suitable. The drive means would then be arranged to either drive all three or, alternatively, to switch the generator tools on the motor drive shaft via a tool changer mechanism. Such two stage polishing operation is not necessary in edge polishing since the surface finish of an edge is no where near as critical as for the optical portion of the lens.

For increased speed of operation, the generator machines described above can be provided with one or more automatic operated and controlled turrets for moving the lens to a loading/unloading stations and to the various cutting and polishing stations.

Figure 8:
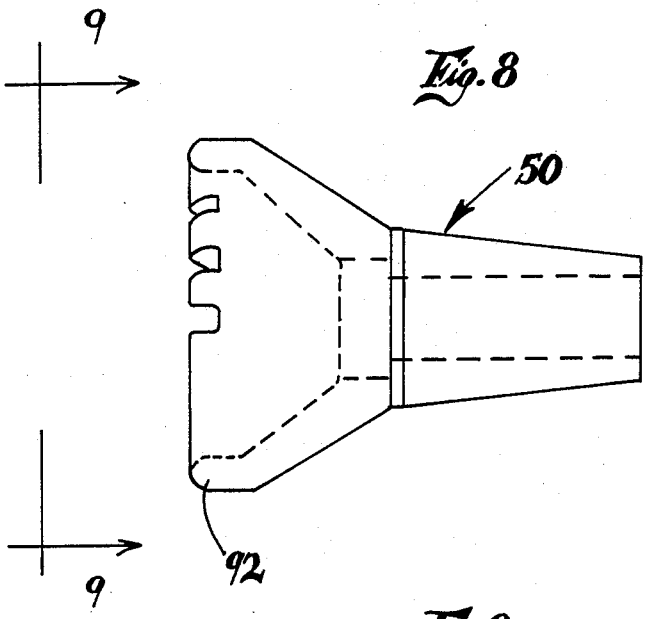
FIG. 8 is an enlarged view of a generator tool of the present invention.
Figure 9:
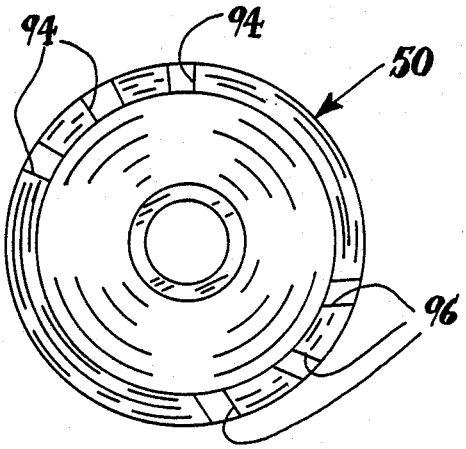
FIG. 9 is a view taken along the line 9—9 of FIG. 8.

Referring to FIGS. 8 and 9, a generator tool 50 of the present invention is shown, and is generally conventional in construction, except it has diamond particles of the size called for by the present invention held in place by a binder called for in the present invention. If the generator machine spindle and bearings are stiff and of close tolerance, a full rim circumference may be provided on tool 50. However, in many existing generator machines, the spindle and bearing are not stiff and close toleranced enough to permit the use of a full rim generator polishing tool, and any attempt to do so will introduce a wavey pattern into the optical surface, which is not desirable. There are two methods to cure this difficulty with some existing generator machines. One approach is to stiffen the machine as by substituting stiffer shaft and/or closer tolerance bearings into the machine which will reduce the waviness. The second approach is reduce the contact the generator tool of the present invention makes with lens. The reduction in contact can take place by reducing the area of the generator tool in contact with the lense. One method to achieve this reduced area of contact is to use as thin a rim 92 generator as possible. Another approach is to provide slots in the rim, be they radial slots 94 as shown in the upper part of FIG. 9, or angular slots 96 shown in the bottom portion of that figure. It is to be understood the slots can be spaced about the entire circumference as desired and/or needed.

While the drive means is shown as a motor, other drive means, such as a powered flexible shaft or shafts could also be used.

While the preferred steps and embodiments of the present invention have been illustrated and described, from the foregoing it should be understood that variations, modifications and equivalent steps and structures thereof fall within the scope of the appended claims.

What is claimed is:

1. A method for machine polishing a plastic ophthalmic lens on an ophthalmic machine to a translucent surface finish, comprising the step of polishing the lens with a polishing wheel comprising a polishing surface including a plurality of diamond particles of substantially seven microns or less in size, and a matrix for holding said diamond particles, said matrix being relatively soft so as not to scratch the plastic lens, said polishing surface and matrix being formed to be compatible with the desired final surface to be given said lens, wherein said lens may be automatically polished to a translucent surface finish.

2. A method as in claim 1, wherein said diamond particles are within a range of from three to five microns in size.

3. A method as in claim 1, wherein said matrix is a metallic material.

4. A method as in claim 3, wherein said matrix is a soft bronze.

5. A method as in claim 1, wherein said matrix is a non-metallic material.

6. A method as in claim 5, wherein said matrix is a resin material.

7. A method as in claim 1, wherein said polishing wheel is in the form of a generator tool, said generator tool polishing an optical surface of the lens.

8. A method as in claim 7, wherein said diamond particles are within a range of from three to seven microns in size.

9. A method as in claim 7, wherein said matrix is a metallic material.

10. A method as in claim 9, wherein said matrix is a soft bronze.

11. A method as in claim 7, wherein said matrix in a non-metallic material.

12. A method as in claim 11, wherein said matrix in a resin material.

13. A method as in claim 1, wherein said polishing wheel is in the form of an edger polishing wheel, said edger polishing wheel polishing the edge of said lens.

14. A method as in claim 13, wherein said diamond particles are within a range of from three to five microns in size.

15. A method as in claim 13, wherein said matrix is a metallic material.

16. A method as in claim 15, wherein said matrix is a soft bronze.

17. A method as in claim 13, wherein said matrix in a non-metallic material.

18. A method as in claim 17, wherein said matrix in a resin material.

19. A method as in claim 1, said ophthalmic machine also having a forming wheel, comprising the prior step of forming the edge lens to the desired shape with the forming wheel prior to polishing.

20. A method as in claim 19, wherein said forming wheel and polishing wheels are flat, whereby said forming and polishing steps produce a translucent, flat edged lens.

21. A method as in claim 19, said ophthalmic machine having a second forming wheel for forming a retaining edge on said lens, comprising the intermediate step of forming the retaining edge on said lens prior to polishing, said polishing wheel having a shape complimentary to said second forming wheel to polish said retaining edge, whereby the edge of said lens is formed and polished to translucent finish.

* * * * *

UNITED STATES PATENT AND TRADEMARK OFFICE

Certificate

Patent No. 4,908,996

Patented: March 20,1990

On petition requesting issuance of a certificate for correction of inventorship pursuant to 35 U.S.C. 256, it has been found that the above-identified patent, through error and without any deceptive intent, improperly sets forth the inventorship. Accordingly, it is hereby certified that the correct inventorship of this patent is:
Joel Friedman and Jean J. Bouvier.

Signed and Sealed this 18th Day of September, 1990.

FREDERICK R. SCHMIDT

*Supervisory Patent Examiner*
Art Unit 323